US005741348A

United States Patent [19]

Van Der Donk et al.

[11] Patent Number: 5,741,348

[45] Date of Patent: Apr. 21, 1998

[54] METHOD FOR REFINING AN ALUMINIUM SCRAP SMELT

[75] Inventors: Henricus Matheus Van Der Donk, Velserbroek; Gerrit Hein Nijhof, Heemstede, both of Netherlands

[73] Assignee: Hoogovens Aluminium BV, Ijmuiden, Netherlands

[21] Appl. No.: 654,342

[22] Filed: May 28, 1996

[30] Foreign Application Priority Data

May 31, 1995 [NL] Netherlands ..... 1000456

[51] Int. Cl.[6] ..... C22B 21/06

[52] U.S. Cl. ..... 75/384; 75/412; 75/684; 420/548

[58] Field of Search ..... 75/684, 412, 384; 420/548

[56] References Cited

U.S. PATENT DOCUMENTS 2,464,610 3/1949 Regner ..... 75/412

FOREIGN PATENT DOCUMENTS 976205 3/1951 France .
55-50442 4/1980 Japan ..... 75/684
1108122 8/1984 U.S.S.R. ..... 75/684

OTHER PUBLICATIONS

Patent Abstracts of Japan, vol. 010 No. 13 (C-340), 18 Apr. 1986 & JP-A-60 234930 (Toyota Jidosha KK) Nov. 1985.

Patent Abstracts of Japan, vol. 940 No. 010 & JP-A-06 299265 (Nippon Light Metal Co Ltd.; others: 01) 25 Oct. 1994.

Database WPI, Section Ch, Week 9519, Derwent Publications Ltd., London, GB; Class M25, AN 9-14191 & JP-A-07 070666 (Nikkei Giken KK/Nippon Light Metal Co), 14 Mar. 1995.

Database WPI, Section Ch, Week 9517, Derwent Publications Ltd., London, GB; Class M25, AN 95-128717 & JP-A-07-54 063 (Nippon Light Metal Co), 28 Feb. 1995.

Patent Abstracts of Japan, vol. 950, No. 002, & JP-A-07 054070 (Nippon Light Metal Co. Ltd.) 28 Feb. 1995.

Database WPI, Section Ch, Week 8510, Derwent Publications Ltd., London, GB; Class M26, AN 85-061392 & SU-A-1 108 122 (DNEPR Metal Inst), 15 Aug. 1984.

"Microstructure Control of Iron Intermetallics in Al-Si Casting Alloys," by Lakshmanan et al, Z. Metallkd. 86 (1995) pp. 457-464, month unavailable.

*Primary Examiner*—Melvyn Andrews
*Attorney, Agent, or Firm*—Larson & Taylor

[57] ABSTRACT

A method of refining a melt of aluminum scrap material which comprises metallic aluminum and impurities including iron, in order to obtain a target iron level. The method includes the steps of determining the initial amounts in the melt of Mn, Fe and Si, adding a quantity of Mn to the melt so as to obtain in the melt, after refining of the melt a ratio of Mn in the melt to a desired target level of Fe. Thereafter, the method includes the steps of homogenizing the melt by heating, cooling the melt and maintaining it at a super-eutectic holding temperature so that solid intermetallic compounds form and finally separating the solid intermetallic compounds from the melt.

6 Claims, 5 Drawing Sheets

METHOD FOR REFINING AN ALUMINIUM SCRAP SMELT

FIELD OF THE INVENTION

The invention relates to a method for refining a melt of aluminium scrap material which comprises metallic aluminium and also impurities including iron. This melt is obtained by melting aluminium scrap material. The invention also relates to the aluminium alloy obtained from the refined melt produced by the method.

DESCRIPTION OF THE PRIOR ART

It is known to refine an aluminium let to remove unwanted metallic impurities by allowing separable solid intermetallic compounds to form. These can be filtered off. U.S. Pat. No. 2,464,610 describes such a process, in which the Fe content of an aluminium-silicon alloy is reduced to less than 0.5% by adding at least one of Mn, Co and Cr in amounts equal to about 0.5 to 2 times the total weight of Fe present, and slowly cooling the alloy to separate the solidus containing a major part of the Fe at a temperature above the eutectic. Another general disclosure of this type is FR-A-976205.

In SU-1108122 (as abstracted by WPI/Derwent), Mn is added to produce low Fe alloy. The amount of Si in the melt is thereby much reduced.

A study of the formation of these intermetallic compounds in Al—Si alloys is to be found in Z. Metallkunde 86 (1995) 7, pages 457–464, which describes the crystallization of coarse sludge particles at high Mn levels.

WPI/Derwent abstracts of JP-A-7-70666 and JP-A-6-234930 describe separation of Al—Fe—Mn—Si intermetallic compounds to reduce Fe levels, and WPI/Derwent abstracts of JP-A-7-54070, JP-A-6-299265 and JP-A-7-54063 show apparatus for carrying out this aluminium refining.

A drawback of refining methods known in practice is that the yield from refining, as expressed in the attainable degree of removal of, in particular, iron, is low. Another drawback is that Mn is overdosed in order to obtain with reasonable certainty a melt which is sufficiently refined in terms of iron.

SUMMARY OF THE INVENTION

The object of the invention is to provide a method of refining a melt of aluminium scrap material, bearing in mind the varying iron contents which may exist in such melts, which achieves with adequate precision a desired low level of Fe.

A further object of the invention is to provide a method of refining a melt of aluminium scrap material which can avoid use of an excessive amount of Mn.

According to the invention there is provided a method of refining a melt of aluminium scrap material which comprises metallic aluminium and impurities including iron, comprising the steps of (i) determining the initial amounts, in % by weight, in the composition of the melt of the elements Mn, Fe and Si, these amounts being identified below as $[Mn_0]$, $[Fe_0]$ and $[Si_0]$;

(ii) adding a quantity $Mn_x$ of Mn to the melt, so as to obtain in the melt, after refining of the melt by steps (iii), (iv) and (v) below, a ratio δ given by $$\delta=[Mn_1]/[Fe_1]$$

wherein $[Mn_1]$ and $[Fe_1]$ are the amounts in % by weight of Mn and Fe in the melt after the refining of the melt, $[Fe_1]$ being a desired target level of Fe and $[Mn_1]$ being given by $$[Mn_1]=A-B*[Fe_1]$$

wherein $$1.86-0.17*[Si_0]+0.004*[Si_0]^2<A<2.21-0.17*[Si_0]+0.005*[Si_0]^2$$

and $$0.42+0.50*exp\ (-0.28*[Si_0])<B<0.57+0.50*exp\ (-0.28*[Si_0]),$$

the added quantity $Mn_x$ of Mn being given by $$Mn_x=\delta*Fe_0-Mn_0$$

wherein $Fe_0$ and $Mn_0$ are the initial quantities of Fe and Mn in the melt of aluminium scrap material;

(iii) homogenizing the melt by heating after step (ii);

(iv) cooling the melt after step (iii) and maintaining the melt at a super-eutectic holding temperature T for a holding time t so that solid intermetallic compounds form;

(v) separating the solid intermetallic compounds from the melt, to obtain the refined melt.

In these mathematical expressions, * denotes multiplication.

The method of the invention is based on selection of the desired end level of Fe, $[Fe_1]$, and addition of the appropriate quantity of Mn, $Mn_x$, to achieve this end level on the basis of the initial Si content, $[Si_0]$, also. It will be apparent that the quantities $Fe_0$, $Mn_0$ and $Mn_x$ are expressed in suitable weight units, e.g. kg.

It has been found that the method in accordance with the invention can sufficiently reduce the content of impurities, in particular iron, without use of an excess of, for example, Mn. This permits a re-usable alloy to be made from aluminium thus refined without any further special measures. Apart from increasing the possible applications for manufacturing re-usable alloys, the absence of the excessive use of additives, in particular Mn, reduces costs.

An important advantage of no excess of Mn is also that in principle no more intermetallic compound than necessary is formed, so that the separation stage is less heavily loaded and this results directly in a higher metal yield.

By working in accordance with the invention it is now possible to arrive precisely at a desired refined composition, without any excess of additives needing to be added. It will be clear that if the quantity ($\delta.Fe_0-Mn_0$) given above is negative, then no Mn needs to be added; there is then more Fe removed than is required for attaining the desired $[Fe_1]$.

Preferably B is given by $$0.45+0.50*exp\ (-0.28*[Si_0])<B<0.50+0.50*exp\ (-0.28*[Si_0]).$$

Preferably, if the melt is an Al—Si12—Fe—Mn system, A lies between 0.76 and 0.80 and B is approximately 0.49. If the melt is an Al—Fe—Mn system preferably A lies between 2.00 and 2.04 and B is approximately 0.96, and if it is an Al—Si8—Fe—Mn system preferably A lies between 0.97 and 1.01 and B is approximately 0.52.

In the method, preferably the separating takes place in a filter with a filter porosity p less than 30 ppi (pores per square inch). This permits a very good Fe removal yield (ηFe) to be achieved.

The Mn may be added in a conventional manner, e.g. as an aluminium alloy.

DESCRIPTION OF TEST EXAMPLES

The invention will now be explained and illustrated by reference to test examples.

These test examples were designed to simulate, under controlled conditions, the formation of intermetallic iron-containing compounds in aluminium alloy melts, and thereby determine the optimized conditions for carrying out the refining of melts of aluminium scrap material containing varying amounts of iron, and having varying target levels of iron after refining. From these test examples there was derived the insight that the method of the invention can be operated successfully to achieve the desired result in terms of low Mn usage and precise Fe reduction. It furthermore became apparent that a particular Si level, e.g. 8% or 12% can be maintained.

EXAMPLE 1

A melt of 12 kg was composed in an induction furnace. The melt consisted of (n percent by weight): 12.1% Si, 0.83% Fe, 0.32% Cr, 0.41% Ti, 0.23% Zr, 0.01% Mo, balance aluminium (and other inevitable impurities). The different elements were supplied via AlSi20, AlFe50, AlZr10, AlCr20, FeMo80 master-alloys and technically pure aluminium (Al99.7). The melt was heated to 855° C. and held at that temperature for 30 minutes to allow all of the master-alloys to dissolve. Subsequently the melt was cooled to 605° C. and held at this temperature for 20 minutes. During cooling and the holding time, intermetallic compounds are formed and will partly deposit into the melt. Afterwards the melt was poured into a preheated filter box with a ceramic foam filter (CFF) with a filter porosity of 20 ppi. The filtrate was analyzed and consisted of: 11.9% Si, 0.62% Fe, 0.15% Cr, 0.12% Ti, 0.09% Zr, traces of Mo, balance aluminium.

EXAMPLE 2

In a manner identical to that of example 1, a melt was made from a composition of (in percent by weight): 11.5% Si, 0.78% Fe, 0.37% Mn, 0.32% Cr, 0.40% Ti, 0.26% Zr, 0.01% Mo, balance aluminium. Using the same process parameters (30 minutes homogenizing at 855° C., cooling to 605° C., holding time 20 minutes, poured onto a 20 ppi CFF filter), following filtration the melt consisted of: 11.4% Si, 0.49% Fe, 0.19% Mn, 0.11% Cr, 0.11% Ti, 0.10% Zr, traces of Mo, balance aluminium.

EXAMPLE 3

In a manner identical to that in examples 1 and 2, a melt was made from a composition of (in percent by weight): 12.6% Si, 0.87% Fe, 0.21% Cr, 0.11% Ti, 0.14% Zr, balance aluminium. Using the process parameters (30 minutes homogenizing at 850° C., cooling to 630° C., holding time 20 minutes, poured onto a 30 ppi CFF filter), following filtration the melt consisted of: 12.8% Si, 0.85% Fe, 0.20% Cr, 0.11% Ti, 0.14% Zr, balance aluminium.

EXAMPLES 4–22

In a manner identical to that in example 1, a number of melts were made whose initial compositions are given in Table 1. The process conditions used are given in Table 2. In all cases the melt was first homogenized for 30 minutes at temperature between 850°–860° C. The composition obtained in examples 4–22 following refinng is given in Table 3.

Tables 1–3 below given respectively the initial composition, the process parameters used and the final composition of the melt for examples 4–22, all amounts being % by weight.

EXAMPLE 23

For the alloy with the initial composition: 12% Si, 2% Fe, 1.5% Mn, 0.2% Cr, balance aluminium the iron removal yield is determined as a function of the process parameters:

holding temperature holding time filter porosity.

The results are expressed graphically, and discussed below.

TABLE 1

Initial composition for examples 4–22 (balance aluminium)

| Example | Si | Fe | Mn |
|---|---|---|---|
| 4 | 11.5 | 1.12 | 0.99 |
| 5 | 11.4 | 1.09 | 1.86 |
| 6 | 11.4 | 1.62 | 0.99 |
| 7 | 11.2 | 1.58 | 1.90 |
| 8 | 11.3 | 2.09 | 0.99 |
| 9 | 11.6 | 2.07 | 1.91 |
| 10 | 12.0 | 1.89 | 1.57 |
| 11 | <0.1 | 1.09 | 0.49 |
| 12 | <0.1 | 1.09 | 0.98 |
| 13 | <0.1 | 1.08 | 1.45 |
| 14 | <0.1 | 1.58 | 0.49 |
| 15 | <0.1 | 1.48 | 0.96 |
| 16 | <0.1 | 1.52 | 1.45 |
| 17 | <0.1 | 1.56 | 1.44 |
| 18 | <0.1 | 1.91 | 0.95 |
| 19 | 8.19 | 1.90 | 0.58 |
| 20 | 8.20 | 1.50 | 0.85 |
| 21 | 8.27 | 1.22 | 1.12 |
| 22 | 8.25 | 0.57 | 1.57 |

TABLE 2

Process parameters used for Examples 4–22

| Example | Holding time | Holding temperature | Filter type |
|---|---|---|---|
| 4 | 15 min | 605° C. | 10 ppi |
| 5 | 15 min | 605° C. | 10 ppi |
| 6 | 15 min | 605° C. | 10 ppi |
| 7 | 15 min | 605° C. | 10 ppi |
| 8 | 15 min | 605° C. | 10 ppi |
| 9 | 15 min | 605° C. | 10 ppi |
| 10 | 15 min | 605° C. | 10 ppi |
| 11 | 15 min | 665° C. | 10 ppi |
| 12 | 15 min | 665° C. | 10 ppi |
| 13 | 15 min | 665° C. | 10 ppi |
| 14 | 15 min | 665° C. | 10 ppi |
| 15 | 15 min | 665° C. | 10 ppi |
| 16 | 15 min | 665° C. | 10 ppi |
| 17 | 15 min | 680° C. | 10 ppi |
| 18 | 15 min | 685° C. | 10 ppi |
| 19 | 30 min | 630° C. | 30 ppi |
| 20 | 30 min | 630° C. | 30 ppi |
| 21 | 30 min | 640° C. | 30 ppi |
| 22 | 30 min | 640° C. | 30 ppi |

TABLE 3

Final composition for examples 4–12 (balance aluminium)

| Example | Si | Fe | Mn |
|---|---|---|---|
| 4 | 11.7 | 0.64 | 0.42 |
| 5 | 11.6 | 0.47 | 0.58 |
| 6 | 11.7 | 0.82 | 0.35 |
| 7 | 11.3 | 0.61 | 0.50 |
| 8 | 11.5 | 1.02 | 0.31 |
| 9 | 12.2 | 0.85 | 0.53 |
| 10 | 12.1 | 0.76 | 0.40 |
| 11 | <0.1 | 1.10 | 0.49 |

TABLE 3-continued

| Final composition for examples 4–12 (balance aluminium) | | | |
|---|---|---|---|
| Example | Si | Fe | Mn |
| 12 | <0.1 | 1.10 | 0.98 |
| 13 | <0.1 | 0.87 | 1.15 |
| 14 | <0.1 | 1.59 | 0.49 |
| 15 | <0.1 | 1.25 | 0.77 |
| 16 | <0.1 | 1.14 | 1.03 |
| 17 | <0.1 | 1.12 | 0.99 |
| 18 | <0.1 | 1.57 | 0.74 |
| 19 | 8.24 | 1.30 | 0.31 |
| 20 | 8.50 | 1.00 | 0.44 |
| 21 | 8.44 | 0.79 | 0.63 |
| 22 | 8.51 | 0.33 | 0.80 |

BRIEF INTRODUCTION OF THE DRAWINGS

The results of the tests in accordance with the examples are illustrated graphically in the accompanying figures:

FIG. 1 shows the initial and final concentrations of an Al—Si12—Fe—Mn system, FIG. 2 shows the final concentrations of an Al—Si12—Fe—Mn system, FIG. 3 shows the initial and final concentrations of an Al—Fe—Mn system, FIG. 4 shows the final concentrations of an Al—Fe—Mn system, FIG. 5 shows the initial and final concentrations of an Al—Al—Si8—Fe—Mn system, FIG. 6 shows the final concentrations of an Al—Si8—Fe—Mn system, FIG. 7 sets out the Mn/Fe ratio in the refined melt plotted against the slope of the lines in FIGS. 1, 3 and 5, FIG. 8 sets out the Fe removal ratio plotted against the filter type at a holding temperature of 605° C. for 30 minutes, FIG. 9 sets out the Fe removal ratio plotted against the holding time, i.e. the time as shown in Table 2, at a holding temperature of 605° C., and FIG. 10 sets out the metal yield, i.e. the weight of the refined melt following filtration relative to the weight of the melt to be refined plotted against the holding temperature, i.e. the temperature as shown in Table 2.

Figure 1:
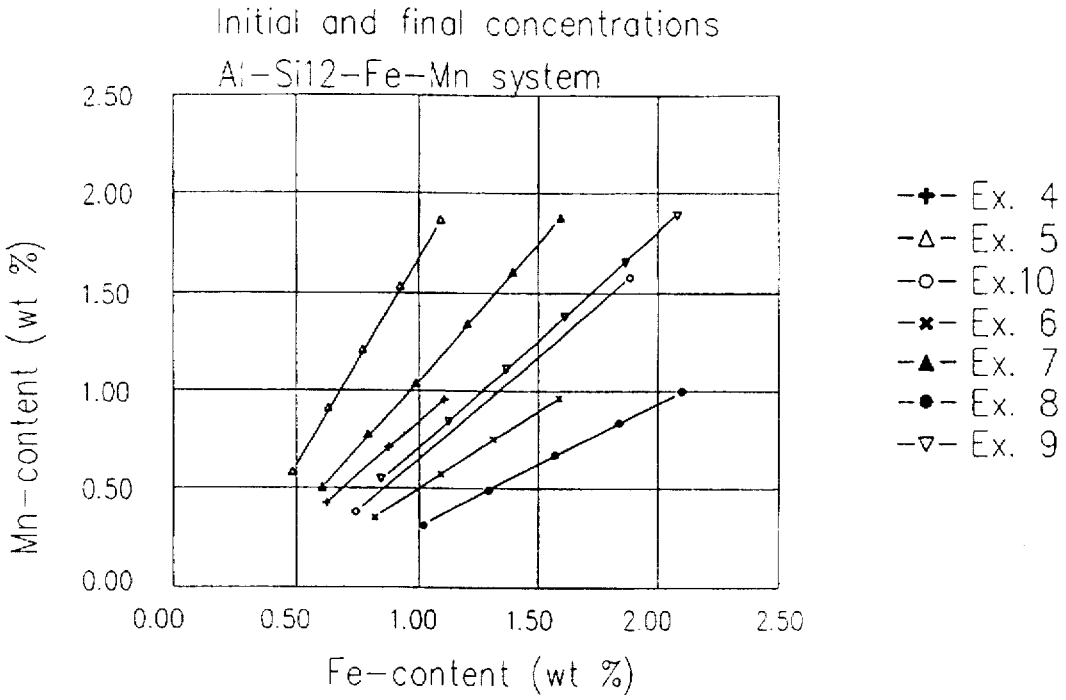
FIGS. 1 and 2 give for examples 4–10 the initial and final compositions respectively for the Fe and Mn content. The initial and final points of each example are linked together by a straight line in FIG. 1.
Figure 2:
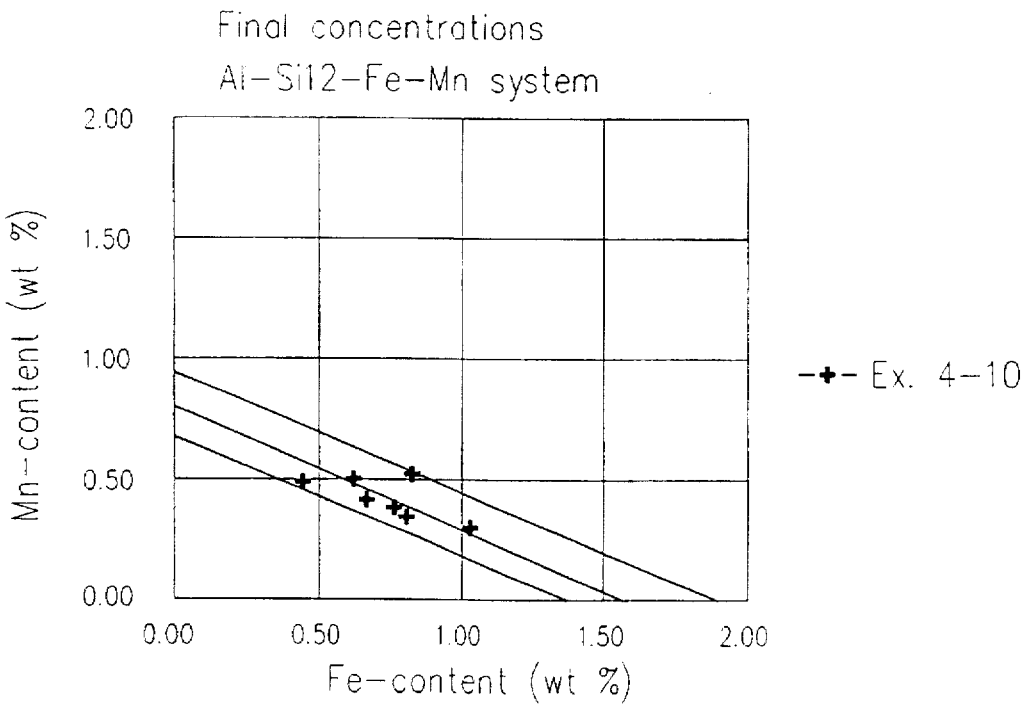

The final compositions in FIG. 1 lie within a certain margin along a straight line when plotted in FIG. 2. This also applies for the final compositions in FIGS. 3 and 5, as plotted in FIGS. 4 and 6.

Figure 3:
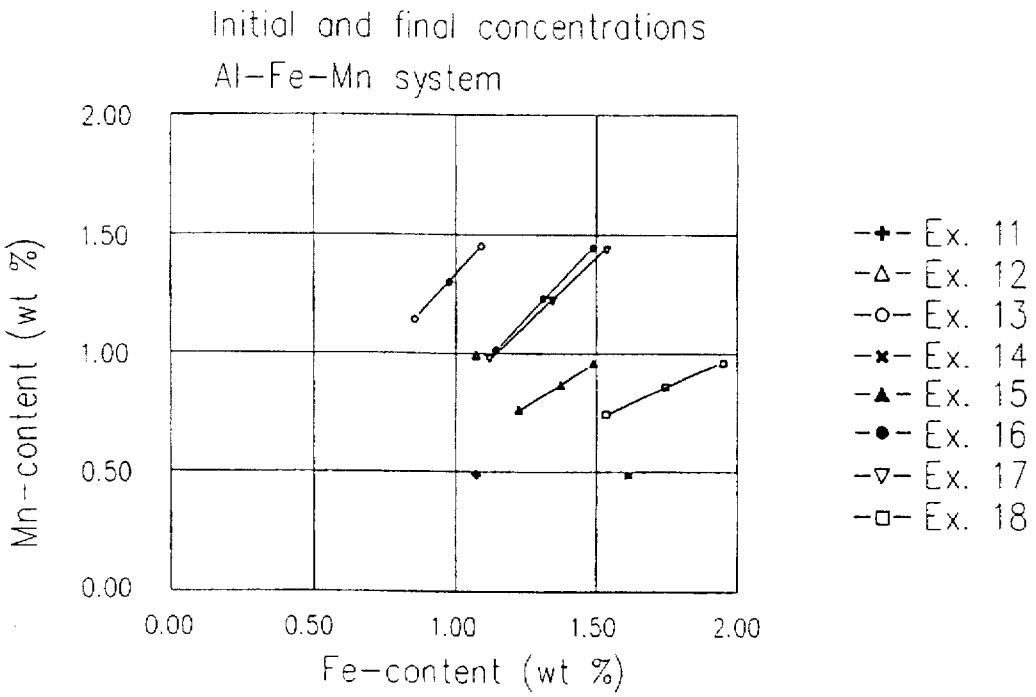
FIGS. 3 and 4 give for examples 11–18 the initial and final compositions respectively for the Fe and Mn content. Here too the points are linked together for each example by straight lines, in FIG. 3.
Figure 4:
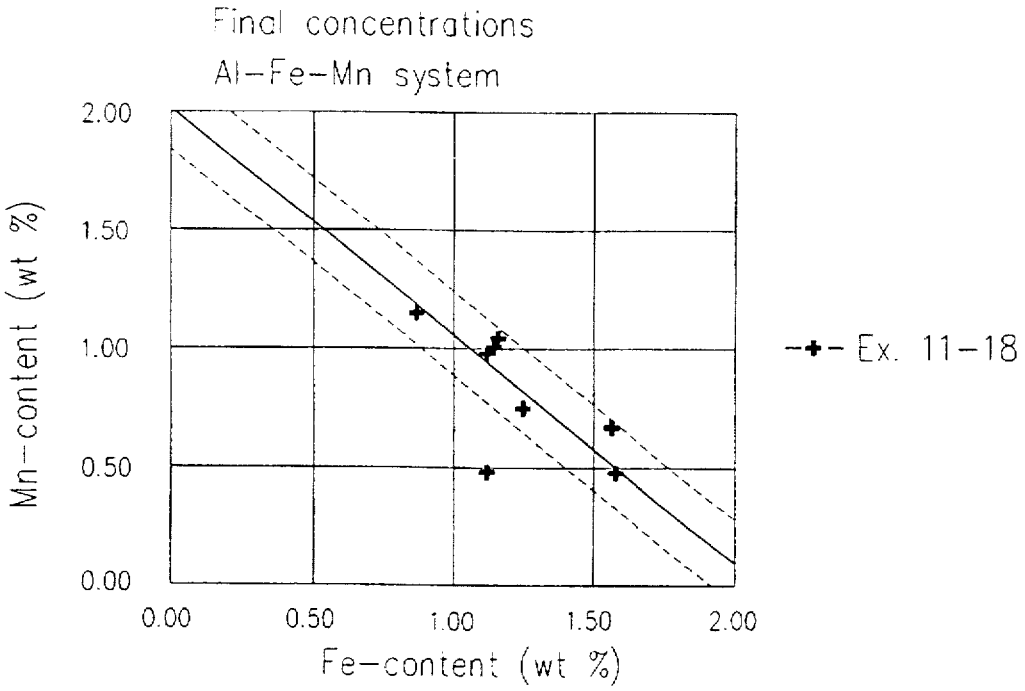
Figure 5:
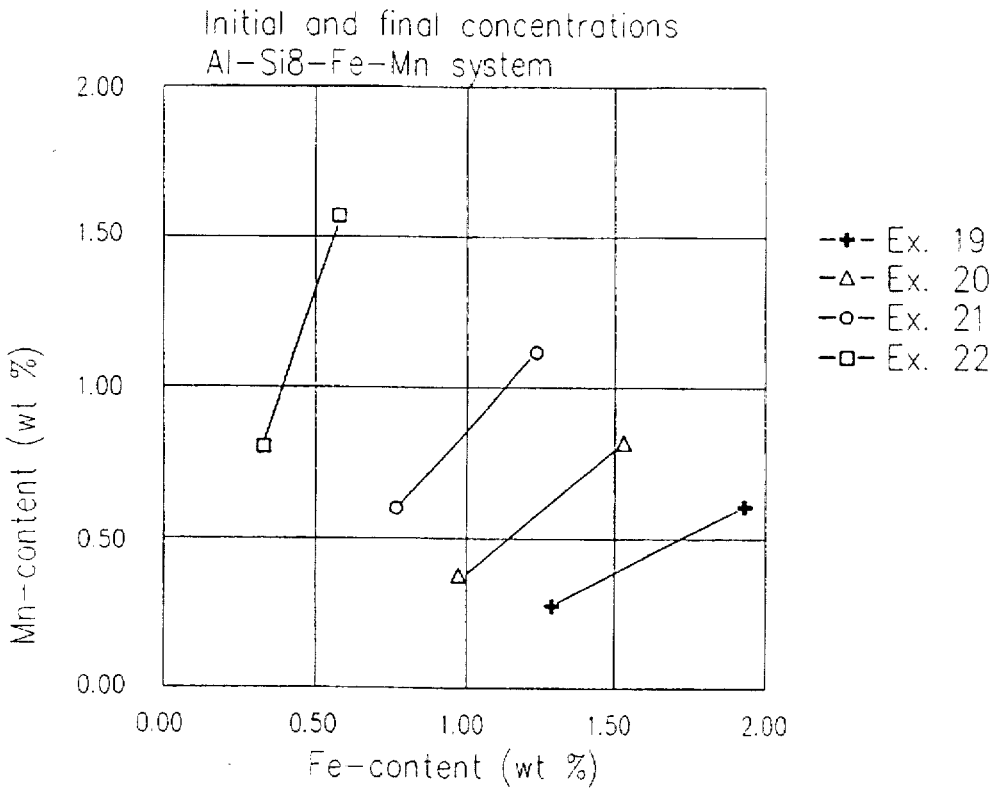
FIGS. 5 and 6 give for examples 19–22 the initial and final compositions respectively for the Fe and Mn content. The respective points for each example are linked together by a straight line in FIG. 5.
Figure 6:
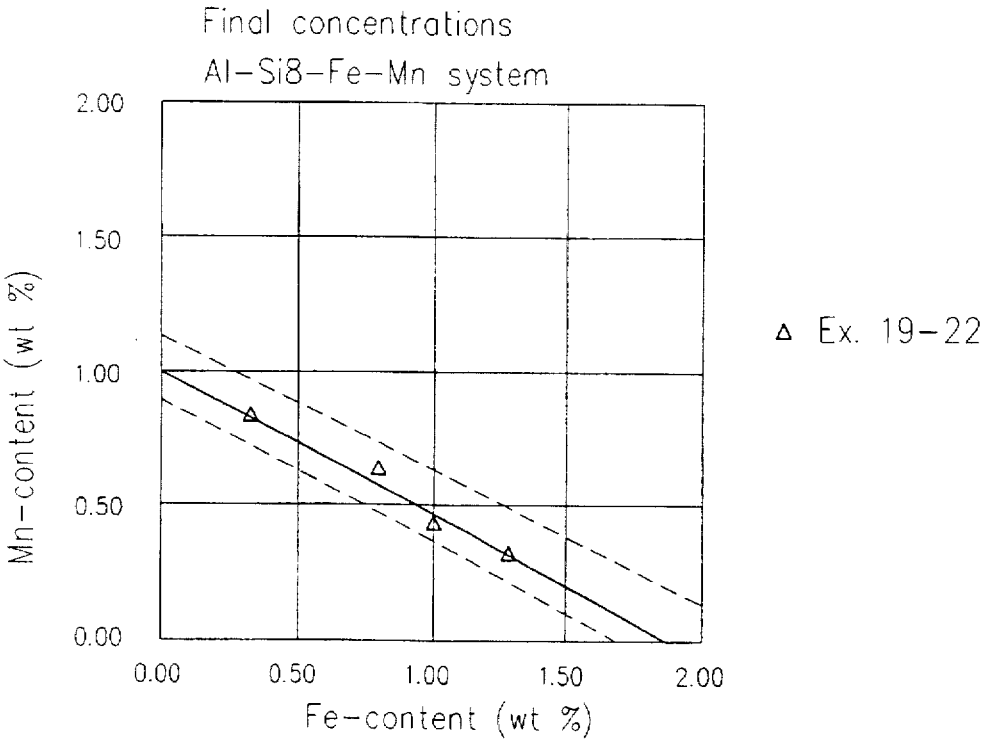
Figure 7:
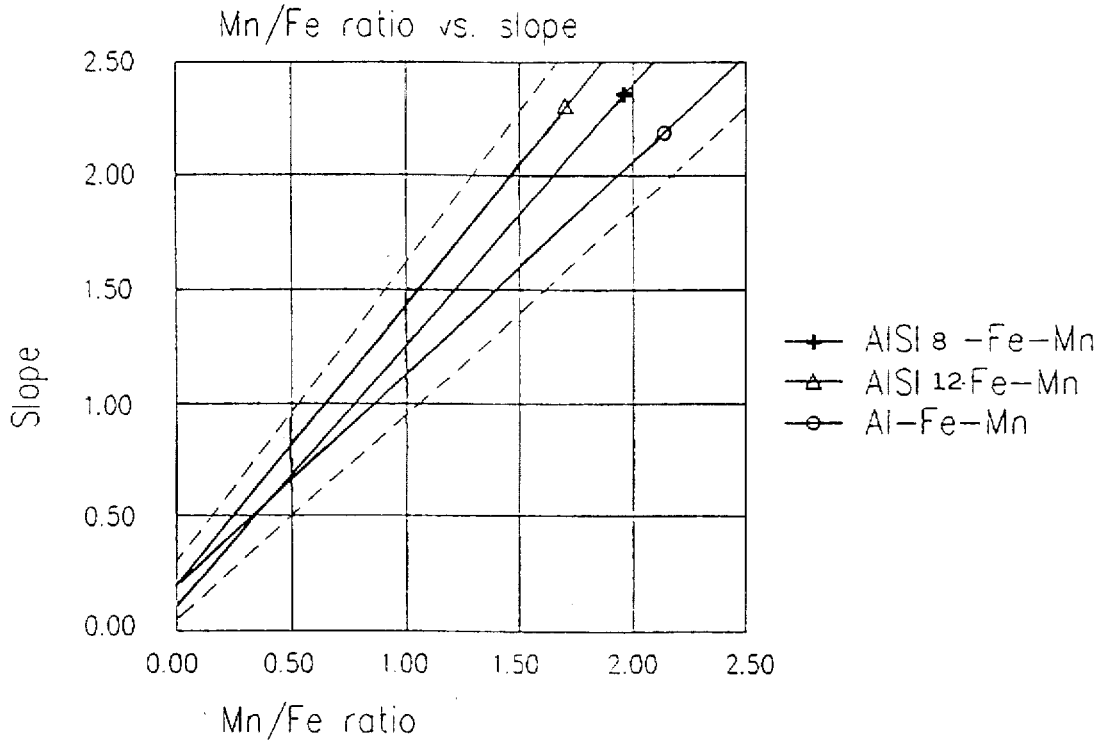

FIG. 7 illustrates the slope of the straight lines from FIGS. 1, 3 and 5 as a function of the initial ratio Mn/Fe. Therefore the slope is a function of the ratio Mn/Fe and the Si content. From this there is derived the insight that the final Fe content can be accurately obtained by adjustment of initial Mn content.

Figure 8:
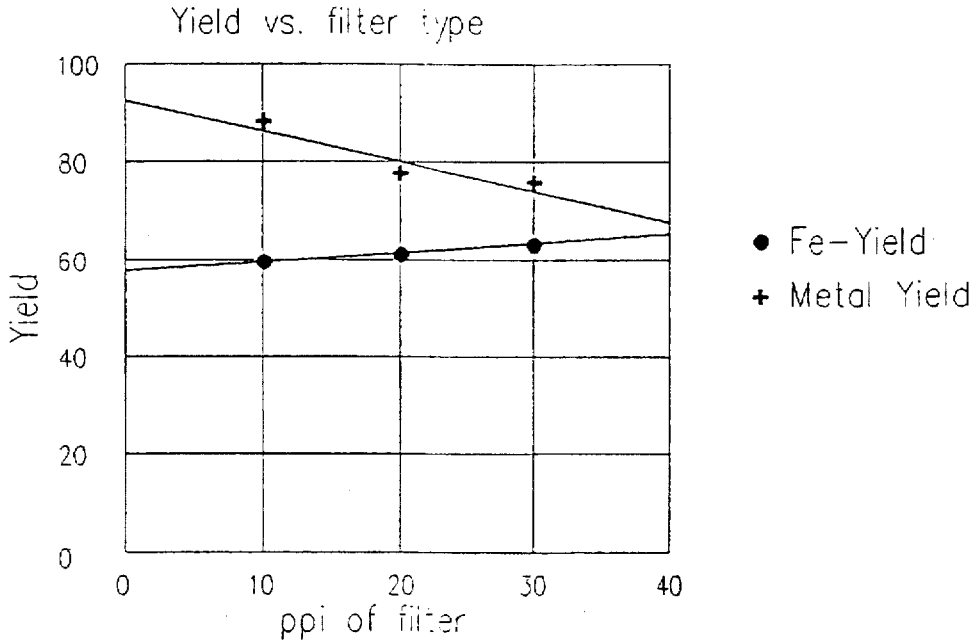
Figure 9:
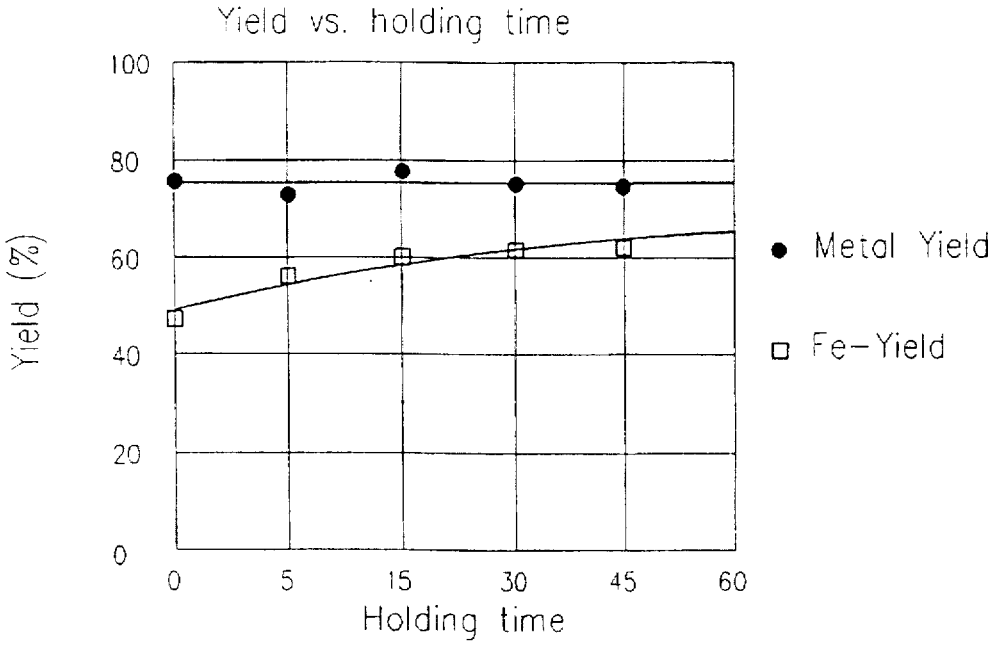
Figure 10:
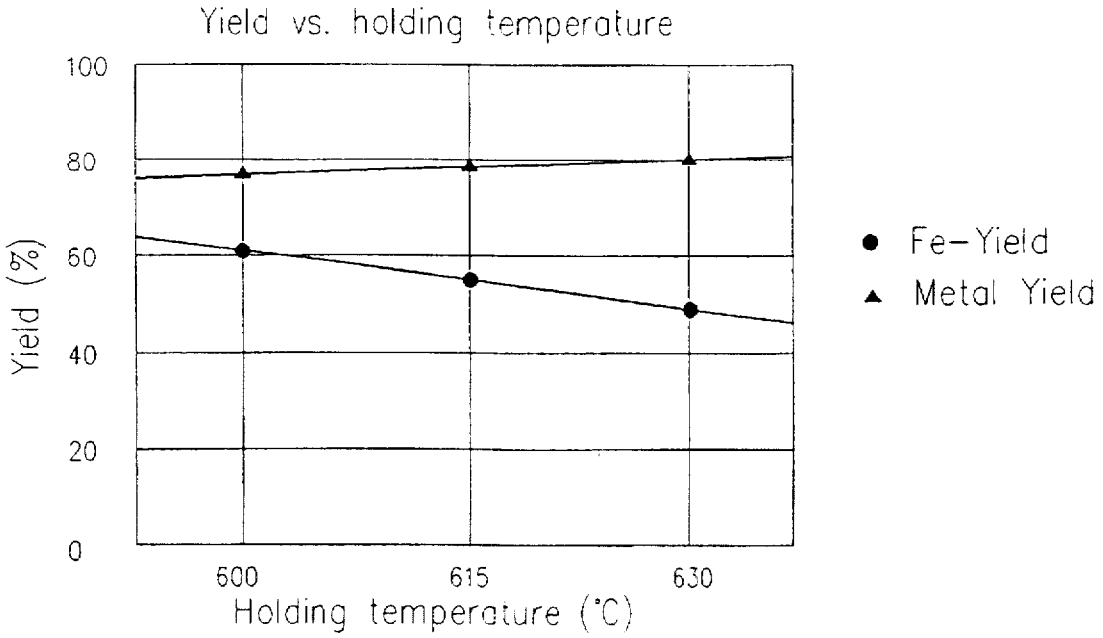

The results of yield measurements in example 23 are illustrated graphically in FIG. 8 (as a function of the filter porosity), FIG. 9 (as a function of the holding time), and FIG. 10 (as a function of the holding temperature).

The Fe removal yield here is the Fe removal ratio (final Fe level relative to initial Fe level). The Fe removal yield ($\eta Fe$) as a function of the filter porosity in ppi may be expressed as $\eta Fe=57.4+0.21\ p$, where p is the filter porosity in ppi at a holding temperature T of 605° C. to t=30 minutes. Furthermore the following relations are found to exist:

$\eta Fe=38.8+11.07\ t-1.31\ t^2$ where t=holding time in min at a holding temperature of 605° C.;

$\eta Fe=60.96-0.2\ T$ where T=holding temperature in °C., at a holding time of 30 min. and a p=30 ppi.

Thus each process may be optimized according to these parameters.

We claim:

1. Method of refining a melt of aluminum scrap material which comprises metallic aluminum and impurities including iron, and in some cases, Mn and Si comprising the steps of (i) determining the initial amounts, in % by weight, in the composition of said melt of aluminum scrap material of the elements Mn, Fe and Si, these amounts being identified below as $[Mn_0]$, $[Fe_0]$ and $[Si_0]$;

(ii) adding a quantity $Mn_x$ of Mn to the melt, so as to obtain in the melt, after refining of the melt by steps (iii), (iv) and (v) below, a ratio $\delta$ given by $$\delta=[Mn_1]/[Fe_1]$$

wherein $[Mn_1]$ and $[Fe_1]$ are the amount in % by weight of Mn and Fe in the melt after the refining of the melt, $[Fe_1]$ being a desired target level of Fe and $[Mn_1]$ being given by $$[Mn_1]=A-B*[Fe_1]$$

wherein $$1.86-0.17*[Si_0]+0.004*[Si_0]^2<A<2.21-0.17*[Si_0]+0.005*[Si_0]^2$$

and $$0.42+0.50*exp\ (-0.28*[Si_0])<B<0.57+0.50*exp\ (-0.28*[Si_0]),$$

said added quantity $Mn_x$ of Mn being given by $$Mn_x=\delta*Fe_0-Mn_0$$

wherein $Fe_0$ and $Mn_0$ are the initial quantities of Fe and Mn in the melt of aluminium scrap material;

(iii) homogenizing the melt by heating after step (ii);

(iv) cooling the melt after step (iii) and maintaining the melt at a super-eutectic holding temperature T for a holding time t to form solid intermetallic compounds comprising iron and manganese;

(v) separating the solid intermetallic compounds from the melt, to obtain the refined melt having a reduced iron content as compared to the melt of aluminum scrap material.

2. A method in accordance with claim 1, wherein $0.45+0.50*\exp(-0.28*[Si_0])<B<0.50+0.50*\exp(-0.28*[Si_0])$.

3. A method in accordance with claim 1, wherein the melt comprises Al—Si12—Fe—Mn and A lies between 0.76 and 0.80 and B is approximately 0.49.

4. A method in accordance with claim 1, wherein the melt comprises Al—Fe—Mn and A lies between 2.00 and 2.04 and B is approximately 0.96.

5. A method in accordance with claim 1, wherein the melt comprises Al—Si8—Fe—Mn and A lies between 0.97 and 1.01 and B is approximately 0.52.

6. A method in accordance with claim 1, wherein the separating step (v) is performed in a filter having a filter porosity p less than 30 ppi (pores per square inch).

* * * * *